US008123379B2

(12) United States Patent
Chen

(10) Patent No.: US 8,123,379 B2
(45) Date of Patent: Feb. 28, 2012

(54) LIGHTING DEVICE WITH SENSOR

(76) Inventor: Kai-Po Chen, Taoyuan Hsien (TW)

( * ) Notice: Subject to any disclaimer, the term of this patent is extended or adjusted under 35 U.S.C. 154(b) by 304 days.

(21) Appl. No.: 12/490,349

(22) Filed: Jun. 24, 2009

(65) Prior Publication Data

US 2010/0328952 A1 Dec. 30, 2010

(51) Int. Cl.
*F21S 8/00* (2006.01)

(52) U.S. Cl. ..... 362/249.05; 362/294; 362/373; 362/448; 362/276

(58) Field of Classification Search ..... 362/218, 362/249.01–249.09, 249.1, 249.11, 249.12, 362/249.14, 249.16, 264, 294, 345, 373, 362/404, 429, 430, 437, 439, 448, 449, 457, 362/458, 480, 547, 580
See application file for complete search history.

(56) References Cited

U.S. PATENT DOCUMENTS

| | | | | |
|---|---|---|---|---|
| 5,258,899 | A * | 11/1993 | Chen | 362/394 |
| 6,309,090 | B1 * | 10/2001 | Tukin | 362/276 |
| 6,540,376 | B2 * | 4/2003 | Victor | 362/642 |
| 6,781,129 | B2 * | 8/2004 | Leen | 250/342 |
| 7,521,872 | B2 * | 4/2009 | Bruning | 315/158 |
| 7,524,089 | B2 * | 4/2009 | Park | 362/294 |
| 7,560,696 | B2 * | 7/2009 | Wu et al. | 250/342 |
| 7,712,927 | B2 * | 5/2010 | Shuai et al. | 362/294 |
| 7,874,710 | B2 * | 1/2011 | Tsai et al. | 362/373 |
| 7,888,851 | B2 * | 2/2011 | Yang et al. | 313/46 |
| 2006/0146537 | A1 * | 7/2006 | Murray et al. | 362/276 |
| 2006/0193151 | A1 * | 8/2006 | Quan et al. | 362/640 |
| 2006/0232974 | A1 * | 10/2006 | Lee et al. | 362/294 |
| 2008/0117647 | A1 * | 5/2008 | Behr et al. | 362/547 |
| 2008/0285271 | A1 * | 11/2008 | Roberge et al. | 362/235 |
| 2009/0080205 | A1 * | 3/2009 | Chang et al. | 362/373 |
| 2009/0103296 | A1 * | 4/2009 | Harbers et al. | 362/234 |

* cited by examiner

*Primary Examiner* — Jong-Suk (James) Lee
*Assistant Examiner* — Stanley Weinberg
(74) *Attorney, Agent, or Firm* — Leong C. Lei

(57) ABSTRACT

The lighting device mainly contains an upper casing, an intermediate casing, a circuit board, and a lower casing. The intermediate casing has a cylindrical body with threads around a top end and a bottom end for joining with the upper and the lower casings, respectively. A spherical concave is provided in the center on the top side of the intermediate casing, surrounded by a number of LEDs. Inside the hollow lower casing, the circuit board is housed with appropriate wiring to the LEDs and a sensor assembly. The lower casing further has electrical contract means on a bottom side for introducing electricity. The spherical sensor assembly is rotatably placed in the spherical concave on the top side of the intermediate casing.

1 Claim, 6 Drawing Sheets

LIGHTING DEVICE WITH SENSOR

TECHNICAL FIELD OF THE INVENTION

The present invention generally relates to lighting devices, and especially relates to a lighting device integrated with a rotatable spherical sensor assembly.

DESCRIPTION OF THE PRIOR ART

Various sensor devices have been widely applied in daily lives. One common application is to integrate a lighting device with a sensor so as to control the lighting device's turning on and off. Another common application is to integrate a video surveillance device with a sensor so that the video surveillance device could be operated more efficiently.

Regardless its type and quality, a sensor usually has a specific sensing direction and a specific coverage. As such, the sensor has to be manually adjusted to aim at the desired direction and coverage or some automatic adjustment means is required before the sensor is put to use. Therefore, the lighting devices and the video surveillance devices integrating the sensors are usually mounted on some pivot and could be adjusted by some lever. However, with these additional means, the lighting devices and the video surveillance devices become bulky. In addition, their coverage and direction are also limited by the pivots and levers. Blind spots are often inevitable with these conventional devices.

SUMMARY OF THE INVENTION

Accordingly, a novel lighting device with an integrated sensor is provided herein to obviate the foregoing shortcomings of the prior arts.

A lighting device according to the present invention mainly contains an upper casing, an intermediate casing, a circuit board, and a lower casing. The intermediate casing has a cylindrical body with threads around a top end and a bottom end of the cylindrical body for joining with the upper casing and the lower casing, respectively. On a top side of the intermediate casing, a spherical concave is provided in the center surrounded by a number of LEDs, which are further surrounded by a ring wall with a number of through openings. Along the circumference of the cylindrical body, a number of heat dissipation openings are provided between the top and bottom threads. Inside the hollow lower casing, the circuit board is housed with appropriate wiring to the LEDs and at least a sensor. The lower casing further has electrical contract means on a bottom side so as to introduce electricity to the circuit board, the LEDs, and other electrical components. A spherical sensor assembly is rotatably placed in the spherical concave on the top side of the intermediate casing.

As such, the sensor assembly could be easily turned to point to a desired coverage area and its rotational angle is not limited to that of the pivots and levers as in the prior arts. In addition, as no levers or pivots are used, the lighting device could have a smaller dimension and could be more flexibly applied to various environments.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As illustrated in FIGS. 1 to 5, a lighting device in accordance with an embodiment of the present invention mainly contains an upper casing 1, an intermediate casing 2, a circuit board 3, and a lower casing 4.

Figure 1:
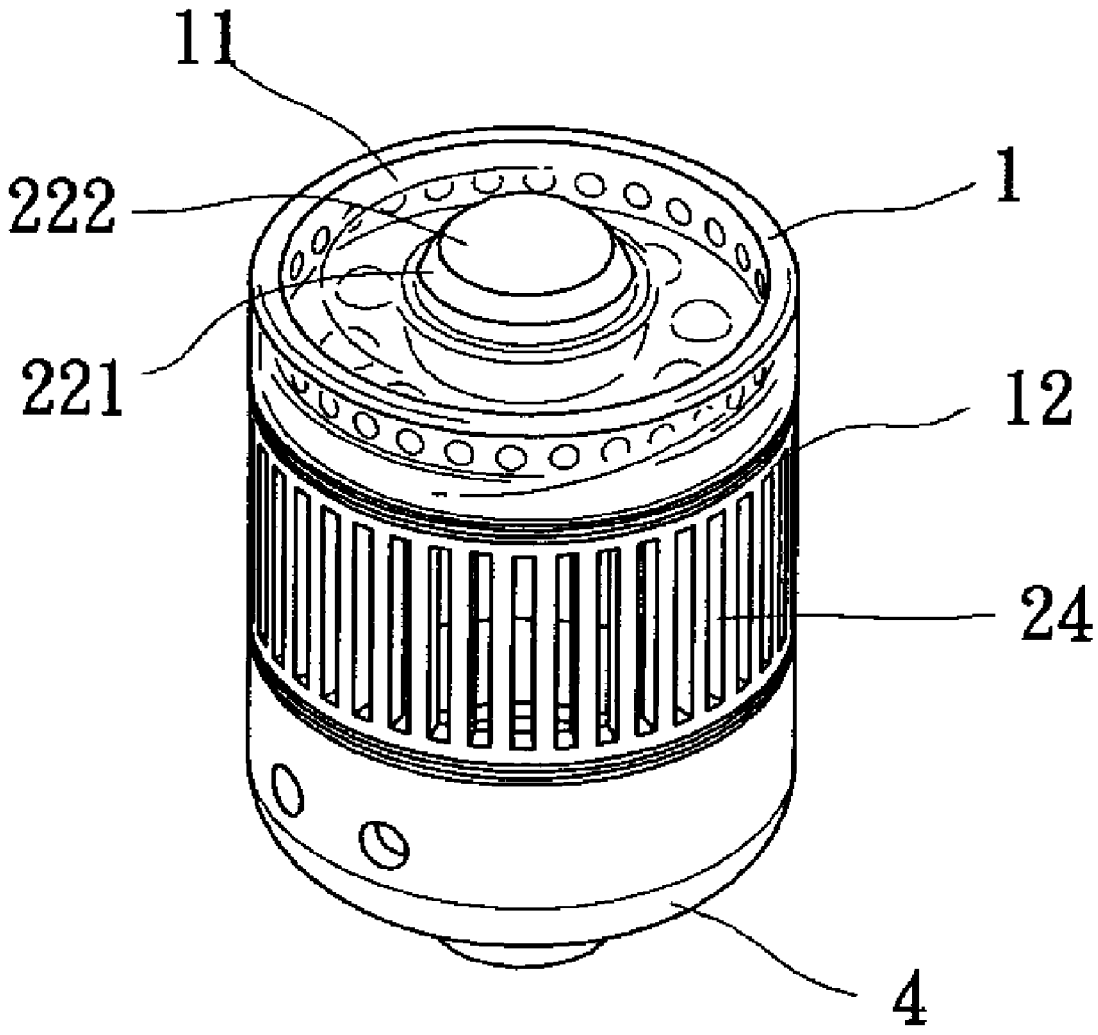
FIG. 1 is a perspective diagram showing a lighting device according to an embodiment of the present invention.
Figure 2:
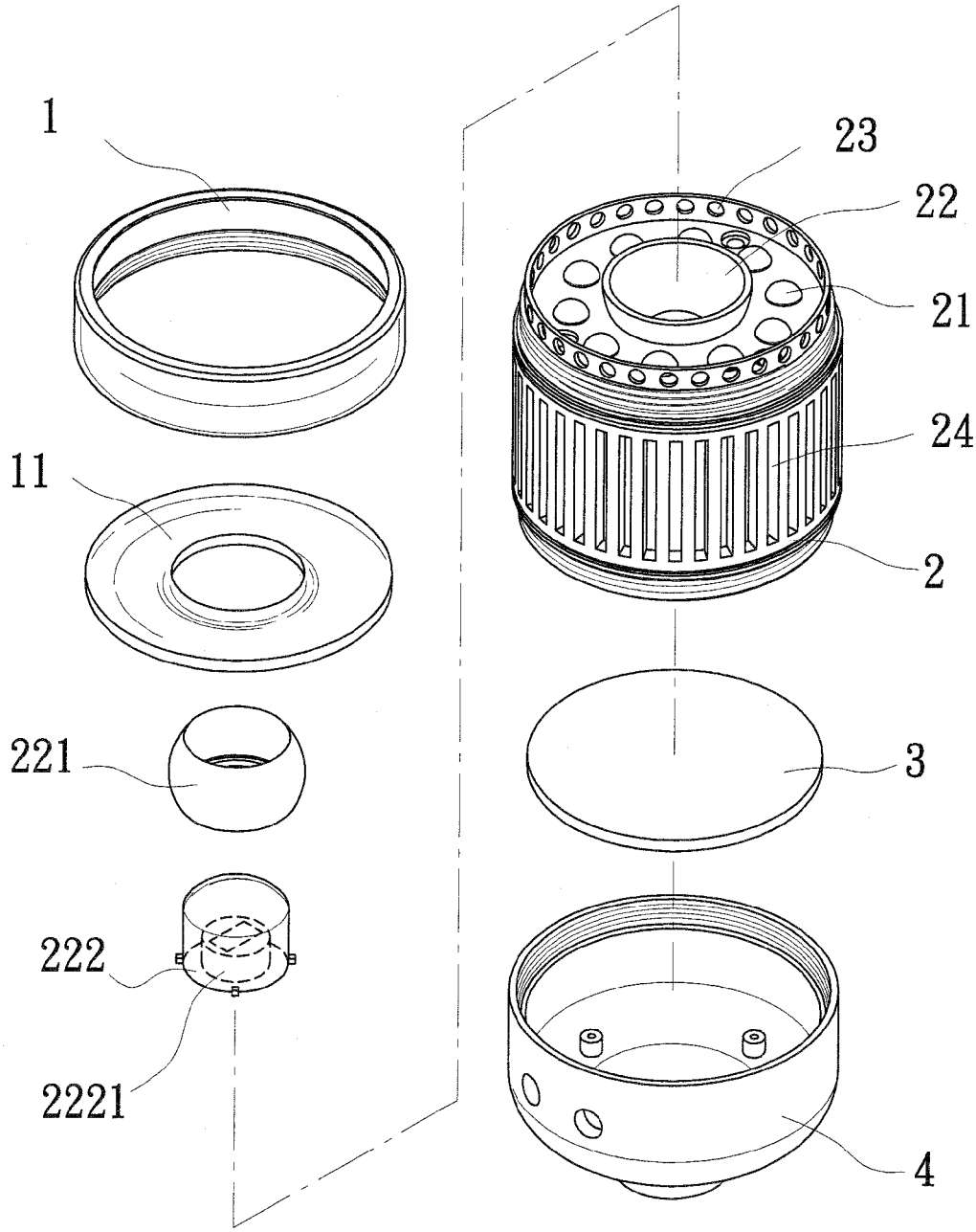
FIG. 2 is a perspective break-down diagram showing the various components of the lighting device of FIG. 1.
Figure 6:
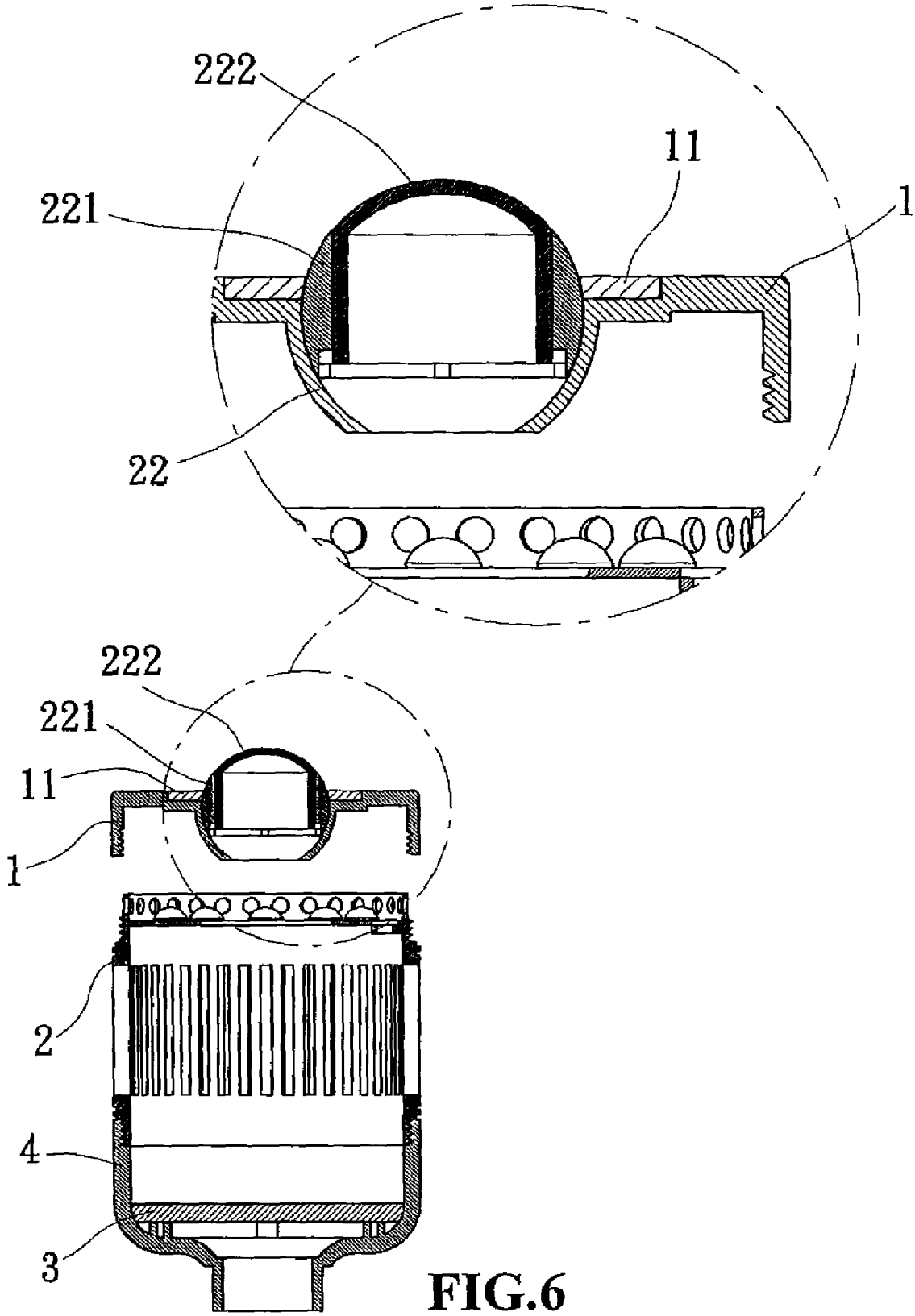
FIG. 6 is a sectional diagram particularly showing the rotatable sensor assembly of a lighting device according to another embodiment of the present invention.
Figure 7:
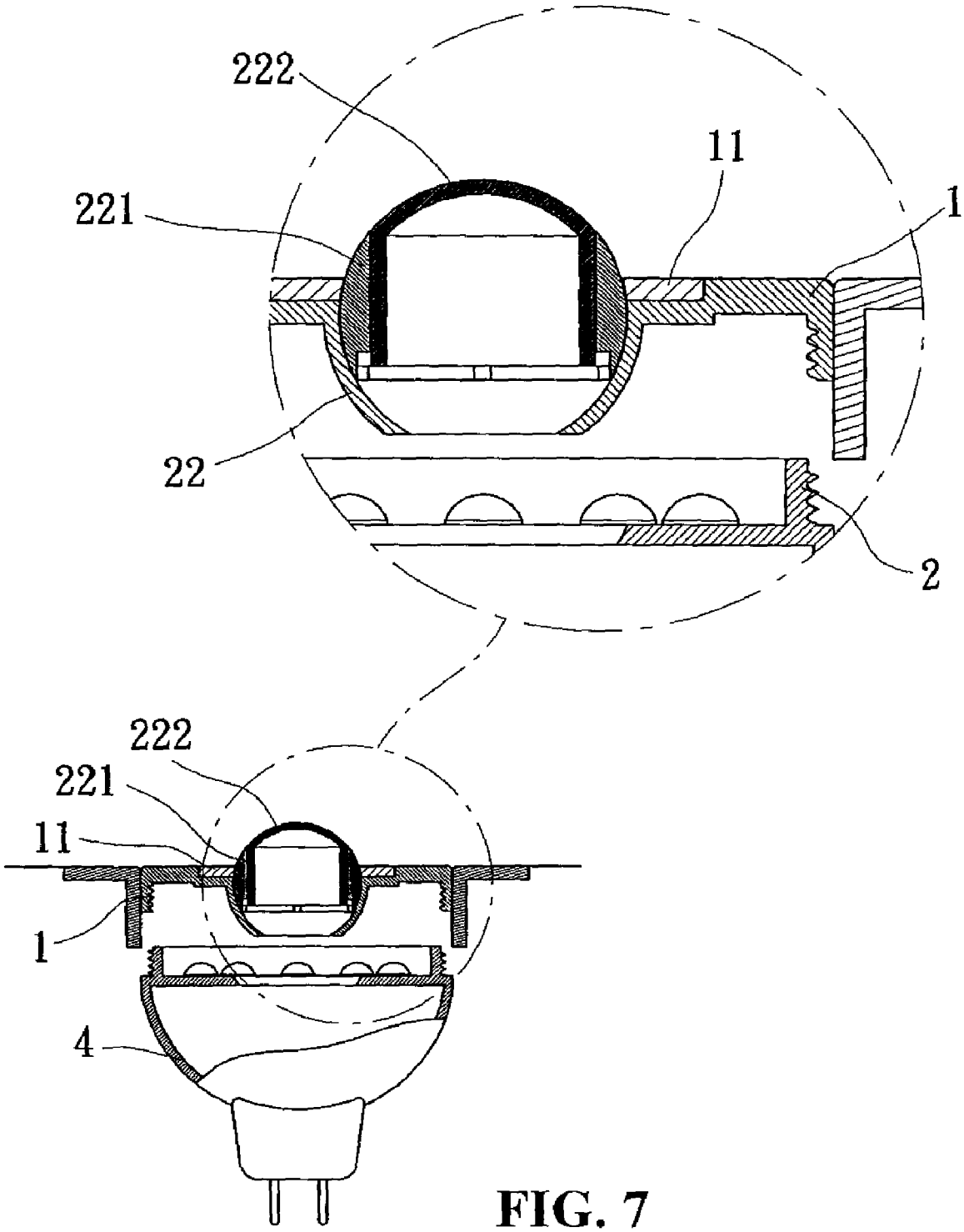
FIG. 7 is a sectional diagram particularly showing the rotatable sensor assembly of a lighting device according to yet another embodiment of the present invention.

As exhibited in FIGS. 1 and 2, the intermediate casing 2 has a cylindrical body with threads around a top end and a bottom end of the cylindrical body for joining with the upper casing 1 and the lower casing 4, respectively. On a top side of the intermediate casing 2, a spherical recess 22 is provided in the center surrounded by a number of light emitting diodes (LEDs) 21, which are further surrounded by a ring wall with a number of through openings 23. Along the circumference of the cylindrical body, a number of heat dissipation openings 24 are provided between the top and bottom threads. Inside the hollow lower casing 4, the circuit board 3 is housed with appropriate wiring to the LEDs 21 and at least a sensor (see FIG. 2). The lower casing 4 further has electrical contact means on a bottom side so as to introduce electricity to the circuit board 3, the LEDs 21, and other electrical components. The sensor 2221 is housed in a cylindrical casing 222 with a spherical top end. The cylindrical casing 222 is then threaded through a ring 221. The cylindrical casing 222 and the ring 221 jointly constitute a substantially spherical shape (hereinafter, the sensor assembly). The sensor assembly is then placed in the spherical recess 22 on the top side of the intermediate casing 2. In an alternative embodiment as shown in FIGS. 6 and 7, the spherical recess 22 (and therefore, the sensor 2221) is provided in the center of the upper casing 1.

For the skillful artisans, it should be obvious that the spherical recess 22 could be configured in various other equivalent positions.

Figure 3:
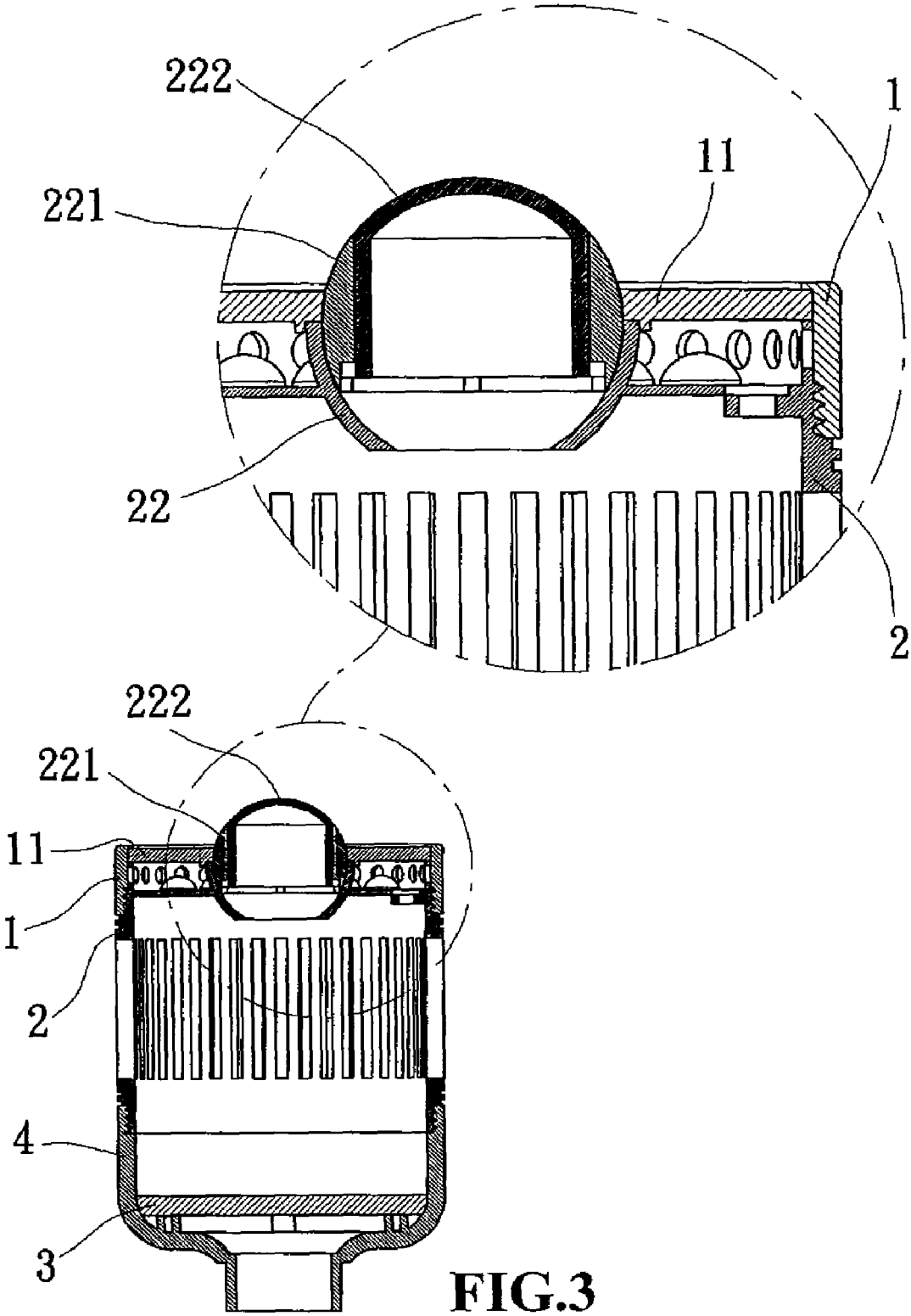
FIG. 3 is a sectional diagram showing the lighting device of FIG. 1.
Figure 4:
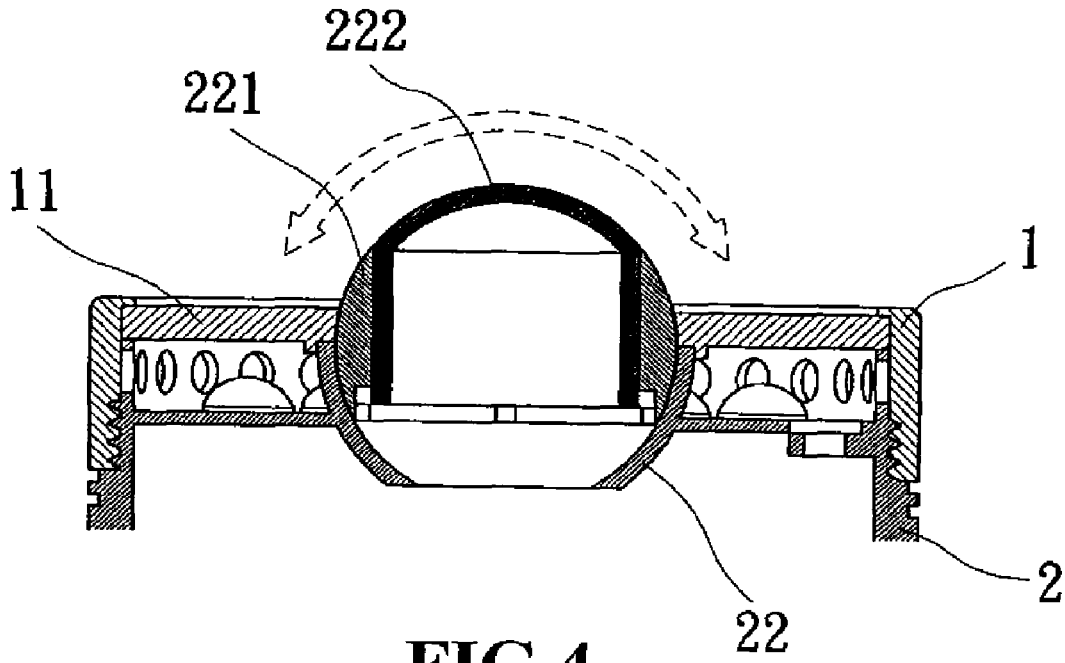
FIG. 4 is a sectional diagram particularly showing the rotatable sensor assembly of the lighting device of FIG. 1.
Figure 5:
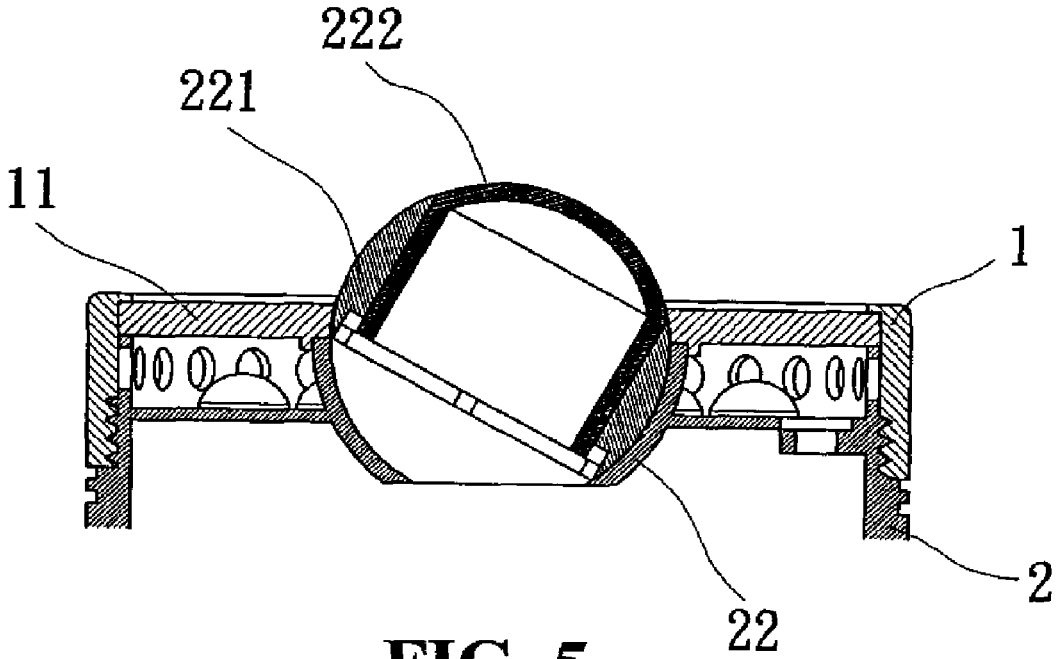
FIG. 5 is a sectional diagram showing that the sensor assembly is turned within the spherical concave of the lighting device of FIG. 1.

As further shown in FIGS. 3 to 5, after placing the sensor assembly in the spherical recess 22, a disc 11 with a central opening is placed over the top side of the intermediate casing 2 so that the sensor assembly is partially exposed from the central opening of the disc 11. Please note that the disc 11 is above the center of the sensor assembly so that the sensor assembly is confined between the disc 11 and the spherical recess 22 while the sensor assembly remains rotatable within this confinement. As such, the sensor assembly (and therefore the sensor inside) could be easily turned to point to a desired coverage area. When a person or some object has entered the coverage area, the sensor 2221 inside the sensor assembly would detect the object and turn on the light emitting diodes 21 of the lighting device. Please note that the sensor assembly is specifically configured into a spherical shape and therefore its rotational angle is not limited to that of the pivots and levers as in the prior arts. In addition, as no levers or pivots are used, the lighting device could have a smaller dimension and could be more flexibly applied to various environments.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A lighting device comprising:

a lower casing having a circuit board inside, said lower casing having a bottom side provided with electrical contact means to introduce electricity to said circuit board;

an intermediate casing having a cylindrical body with threads around a top end and a bottom end of said cylindrical body for joining with said upper casing and said lower casing respectively, a top side of said intermediate casing having a center provided with a spherical recess surrounded by a plurality of light emitting diodes which are further surrounded by a ring wall with a plurality of through openings, said light emitting diodes being connected with said circuit board, said cylindrical body having a circumference provided with a plurality of heat dissipation openings between said top and said bottom ends of said cylindrical body;

an upper casing engaged with said threads of said top end of said intermediate casing;

a sensor assembly including a ring, a cylindrical casing threaded through said ring, and a sensor housed in said cylindrical casing, said cylindrical casing having a spherical top end, said sensor assembly being placed in said spherical recess of said intermediate casing, said cylindrical casing and said ring jointly constituting a spherical shape;

a disc placed over a top side of said intermediate casing and having a central opening thereby causing said sensor assembly to be partially exposed from said central opening of said disc, said disc being positioned above a center of said sensor assembly so that said sensor assembly is confined between said disc and said spherical recess while said sensor assembly remains rotatable respect to said spherical recess thereby enabling said sensor assembly to be turned to point to a desired coverage area;

wherein when an object has entered coverage area, said sensor inside said sensor assembly will detect said object and turn on said light emitting diodes.

* * * * *